US008957338B2

(12) United States Patent
Li

(10) Patent No.: US 8,957,338 B2
(45) Date of Patent: Feb. 17, 2015

(54) TRIGGER ACTION SWITCH OPERATOR

(75) Inventor: Jun Li, Shanghai (CN)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 548 days.

(21) Appl. No.: 13/282,329

(22) Filed: Oct. 26, 2011

(65) Prior Publication Data

US 2012/0103774 A1 May 3, 2012

(51) Int. Cl.

| | |
|---|---|
| ***H01H 13/70*** | (2006.01) |
| ***H01H 13/50*** | (2006.01) |
| ***H01H 3/02*** | (2006.01) |
| *H01H 3/50* | (2006.01) |

(52) U.S. Cl.

CPC ..... *H01H 13/50* (2013.01); *H01H 3/022* (2013.01); *H01H 3/50* (2013.01); *H01H 2003/0233* (2013.01); *H01H 2003/024* (2013.01)

USPC ..... 200/345

(58) Field of Classification Search

USPC ..... 200/313, 314, 316, 329, 341, 345, 520, 200/524, 529, 50.02, 43.07, 16 R, 17 R; 439/394

See application file for complete search history.

(56) References Cited

U.S. PATENT DOCUMENTS

| | | | | |
|---|---|---|---|---|
| 5,091,611 | A * | 2/1992 | Reeves et al. | 200/60 |
| 6,198,058 | B1 | 3/2001 | Graninger et al. | |
| 6,376,785 | B1 | 4/2002 | Graninger | |
| 6,531,669 | B1 | 3/2003 | Miller et al. | |
| 7,342,194 | B2 | 3/2008 | Karweik et al. | |
| 7,371,986 | B2 | 5/2008 | Varland et al. | |
| 7,541,555 | B2 * | 6/2009 | Chang | 200/524 |
| 2006/0063416 | A1 * | 3/2006 | Takagi | 439/394 |

* cited by examiner

*Primary Examiner* — Edwin A. Leon
(74) *Attorney, Agent, or Firm* — Fletcher Yoder, P.C.

(57) ABSTRACT

A switch operator is provided that includes a single piece actuator shaft coupled to a single piece cap. According to certain embodiments, the actuator shaft may be snap fit to the cap. The cap may include an annular sleeve and an annular skirt that extend orthogonally from the cap. The sleeve includes recesses that receive tabs of the actuator shaft to couple the actuator shaft to the cap. In certain embodiments, the actuator shaft may include slots that allow the actuator shaft to flex upon attachment to from the cap. A bushing encircles the actuator shaft and extends into the cap where the bushing is disposed between the annular sleeve and a skirt. The actuator shaft also includes a pair of diametrically opposed slots that house a detent assembly. The detent assembly may be employed to retain the switch operator in the actuated position and in the unactuated position.

20 Claims, 5 Drawing Sheets

TRIGGER ACTION SWITCH OPERATOR

CROSS REFERENCE TO RELATED APPLICATIONS

This application claims priority from and the benefit of Chinese Application No. 201020599142.1, filed on Nov. 1, 2010 entitled "Programmable Controller Component with Assembly Alignment Features", which is herein incorporated by reference.

BACKGROUND

The invention relates generally to the field of electrical switches, and more particularly to a switch operator for controlling an electrical switch assembly.

Electrical switch assemblies are widely used to control industrial equipment. Typically, an electrical switch assembly includes a switch operator, such as a push button, that is mounted to a front of a panel. The electrical switch assembly also includes an electrical switch, such as a contact block, that is mounted on the back of the panel and connected to equipment controlled by the switch. A latch assembly is also mounted on the back of the panel and used to secure the switch operator to the electrical switch.

A contact block generally includes a housing that contains normally opened and/or normally closed contacts. Actuation of the switch operator engages or disengages the contacts, thereby altering an operational state of equipment connected to the electrical switch assembly through the contact block. For example, when a normally opened contact is employed, actuation of the switch operator closes the normally opened contact to engage and/or start operation of equipment connected to the contact block. In contrast, a normally closed contact may be employed to stop an ongoing function by actuation of the switch operator. One common example of a normally closed contact is an emergency stop (E-Stop), where the switch operator may be activated to immediately terminate an ongoing function. E-Stops are generally designed to be self-latching, meaning that the E-Stop stays in the actuated position until it is physically reset. Further, to comply with governmental and/or organization standards, E-Stops can be designed to meet anti-tease or trigger action requirements, which specify that the E-Stop should latch in order to open the normally closed contacts. In other words, it should not be possible for the E-Stop to open the normally closed contacts without latching.

E-Stops often employ numerous internal parts and structural features to provide the self-latching and/or anti-tease features. However, the use of numerous parts can complicate manufacturing and increase tooling investments and material costs. There is a need, therefore, for improved switch operator designs that simplify the number of parts while providing self-latching and/or anti-tease features.

BRIEF DESCRIPTION

The present invention provides a novel switch operator designed to respond to such needs. The switch operator includes a single piece actuator shaft coupled to a single piece cap. The cap encloses an end of the actuator shaft and includes an annular sleeve that extends between the actuator shaft and a bushing disposed around the actuator shaft. According to certain embodiments, the sleeve includes a pair of recesses that receive tabs of the actuator shaft to snap fit the cap to the actuator shaft. The actuator shaft may also include slots that allow the actuator shaft to flex upon attachment to the cap.

The actuator shaft further includes a pair of diametrically opposed slots that house a detent assembly. According to certain embodiments, the detent assembly includes a pair of detents biased from one another by one or more detent springs that extend through the actuator shaft. A drive spring is disposed in the actuator shaft and extends within the actuator shaft from the cap to a shoulder of the actuator shaft.

When the switch operator is in the unactuated position, the detents extend beyond the diameter of the actuator shaft to contact cam surfaces in the bushing. Upon actuation of the switch operator, the drive spring applies force to the one or more detent springs via the actuator shaft, causing them to compress, thereby allowing the detents to retract towards the interior of the actuator shaft. When the detents are retracted, the actuator shaft can slide past the cam surfaces in the bushing, to place the switch operator in the triggered position. In the triggered position, prongs of the switch operator extend past the bushing to engage electrical contacts within a contact block. For example, if the contacts are normally closed, the prongs may interface with features in the contact block to open the electrical contact pairs and terminate an ongoing function.

In the triggered position, the detents are again biased from one another by the one or more detent springs. For example, the movement of the actuator shaft past the cam surfaces may alleviate the force applied to the detent assembly by the drive spring via the actuator shaft, thereby allowing the detent springs to expand. In the biased position, the detents extend beyond the diameter of the actuator shaft to contact the other side of the cam surfaces. Accordingly, the detents retain the switch operator in the triggered position. According to certain embodiments, the interaction between the cam surfaces and the detent assembly allows the switch operator to be self-latching. The switch operator can then be pulled or twisted with respect to the bushing to return the switch operator to the unactuated position.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
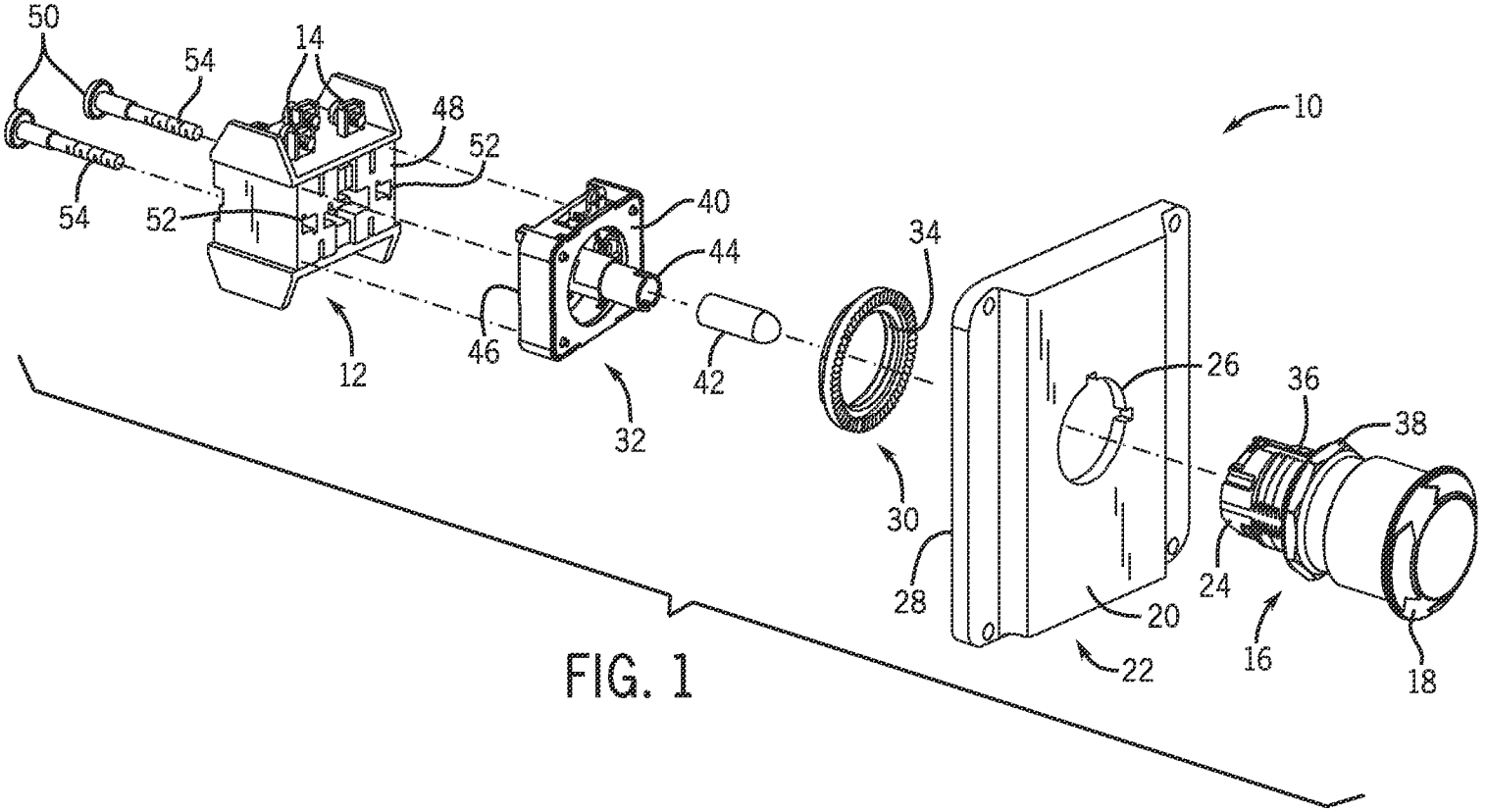
FIG. 1 is an exploded view of an exemplary switch assembly that may employ a switch operator in accordance with the present techniques.

FIG. 1 is an exploded view of a switch assembly 10 that may be manipulated by a user to control a device, such as industrial machine, that is connected to the switch assembly. The switch assembly 10 includes a switching device, such as a contact block 12 that includes receptacles 14 that enable wires and/or ring lug connectors to be coupled to one or more internal electrical contact pairs that are normally opened or normally closed. Switch assembly 10 also includes a switch operator 16 that can be actuated by a user to move the electrical contact pairs within the contact block 12 between opened and closed positions. In particular, the switch operator 16 includes a cap 18 that serves as a button and extends from a front side 20 of a panel 22. According to certain embodiments, the panel 22 may be a sheet metal panel that houses one or more switch operators 16.

The cap 18 can be depressed by a user to actuate the switch operator 16 and engage the contact block 12, thereby changing the position of the internal electrical contact pairs. According to certain embodiments, the switch operator 16 may be a push-pull type operator or a twist-to-release operator that, upon user actuation, remains in the actuated position until physically released, for example, by twisting or pulling. In certain embodiments, the switch operator 16 may function as an E-Stop by opening normally closed contacts within contact block 12 when actuated. Further, the switch operator 16 may be self-latching and/or may have a trigger action as discussed below with respect to FIGS. 3 to 5.

The switch operator 16 also includes a bushing 24 that extends through an aperture 26 within the panel 22 to be secured to a rear side 28 of the panel 22. For example, the bushing 24 can be coupled to a mounting ring 30 and a latch assembly 32. The mounting ring 30 includes threads 34 that interface with a threaded portion 36 of the bushing 24 to couple the mounting ring 30 to the bushing 24, with the panel 22 disposed between the mounting ring 30 and the portion of the switch operator 16 that extends from the front side 20 of the panel 22. The bushing 24 also includes a flange 38 that is disposed against the front side 20 of the panel 22.

The latch assembly 32 includes one or more retention features designed to mate with complementary retention features on the switch operator 16 to couple the latch assembly 32 to the switch operator 16, as discussed further below with respect to FIG. 2. According to certain embodiments, the latch assembly 32 may be inserted onto the bushing 24 and snapped into place by hand. When assembled, a front side of the latch assembly 32, shown here as a cover 40, may be disposed against the rear side 28 of the panel 22. An optional lamp 42 may be inserted into a lamp socket 44 of the latch assembly 32 to illuminate the cap 18 of switch operator 16. For example, the lamp socket 44 and the lamp 42 may be inserted into the bushing 24 and may extend through the aperture 26 in the panel 22. However, in other embodiments where illumination is not desired, the lamp 42 and/or the lamp socket 44 may be omitted. Further, in certain embodiments, gaskets, seals, and/or fasteners may be employed to secure the switch operator 16 to the panel 22, instead of, or in addition to, the mounting ring 30.

The latch assembly 32 also provides a mounting surface for the contact block 12. In particular, a rear surface, shown here as a base 46, may provide a mounting surface for a housing 48 of the contact block 12. Fasteners 50, such as screws, may be inserted through openings 52 in the housing 48. Threaded portions 54 of the fasteners 50 may extend into the latch assembly 32 where the threaded portions 54 may mate with complementary threads in the latch assembly 32. As shown in FIG. 1, two fasteners 50 are employed to secure the contact block 12 to the latch assembly 32. However, in other embodiments, any number of one or more fasteners 50 may be employed.

Figure 2:
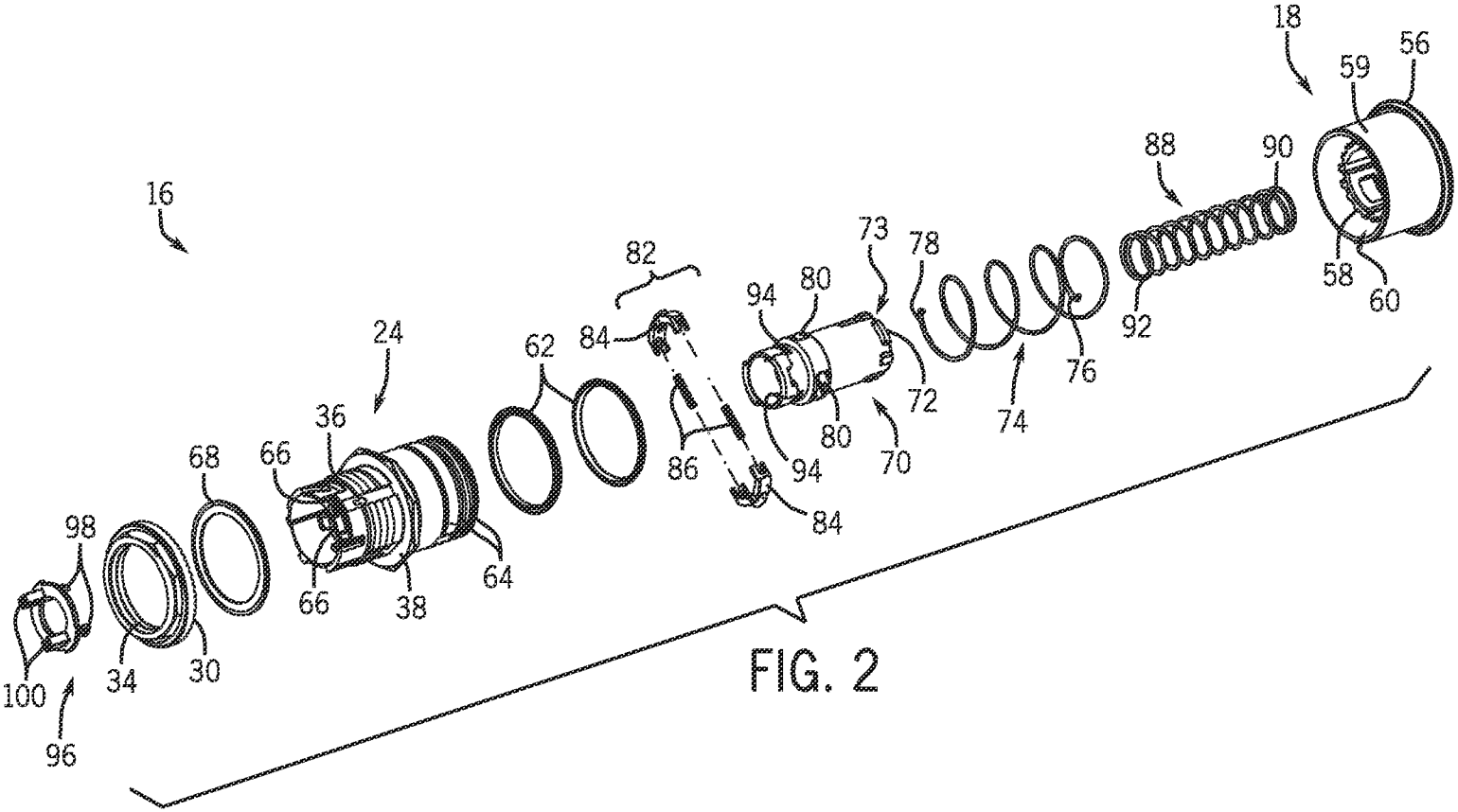
FIG. 2 is an exploded view of the switch operator of FIG. 1.

FIG. 2 is an exploded view of the switch operator 16. The switch operator 16 includes the cap 18, which has an end 56 that may be pressed towards the bushing 24 by a user to actuate the switch operator 16. An annular sleeve 58 extends orthogonally from the end 56 and is surrounded by an annular skirt 59 to form an annular opening 60 therebetween. The annular skirt 59 also extends orthogonally from the end 56 and, in certain embodiments, may be disposed concentrically about the annular sleeve 58. According to certain embodiments, the cap 18 may be a single piece that is molded, for example, out of a thermoplastic material.

The cap 18 is coupled to the bushing 24, which is disposed within the annular opening 60 between the sleeve 58 and the skirt 59. For example, a portion of the bushing 24 may extend into the cap 18 between the skirt 59 and the sleeve 58 to encircle the sleeve 58. According to certain embodiments, the bushing 24 may be interference fit between the skirt 59 and the sleeve 58. For example, seals 62 can be disposed over ridges 64 of the bushing 24 to retain the bushing 24 within the cap 18. According to certain embodiments, the seals 62 may allow rotation of the cap 18 with respect to the bushing 24.

The bushing 24 also includes retention features 66, such as slots and/or grooves designed to mate with complementary retention features of the latch assembly 32. According to certain embodiments, the retention features 66 may facilitate snap attachment of the bushing 24 to the latch assembly 32. For example, as shown in FIG. 1, the bushing 24 may be inserted through the panel 20 until the flange 38 of the bushing is proximate to the panel 20. As shown in FIG. 2, a gasket 68 can be disposed between the flange 38 and the panel 22. According to certain embodiments, the gasket 68 may be designed to seal the panel 20 and/or the switch operator 16 from liquids and particulates, such as dust. Returning to FIG. 1, the mounting ring 30 and the latch assembly 32 can then be coupled to the bushing 24 to secure the switch operator 16 to the panel 20. For example, the retention features 66 of the bushing 24 may be snapped into corresponding retention features of the latch assembly 32.

As shown in FIG. 2, the switch operator 16 also includes an actuator shaft 70 that can be inserted through the bushing 24 to form an annular space between the actuator shaft 70 and the bushing 24. To retain the actuator shaft 70 within the bushing 24, the actuator shaft 70 can be coupled to the interior of the sleeve 58, with the sleeve 58 disposed between the actuator shaft 70 and the bushing 24. In particular, one or more tabs 72 of the actuator shaft 70 can be inserted and/or snap fit within corresponding recesses in the sleeve 58, as described further below with respect to FIG. 6. According to certain embodiments, the actuator shaft 70 is a single unitary piece that may be molded, for example, out of a thermoplastic material. However, in other embodiments, the actuator shaft 70 may be metal or another suitable material. When assembled, the cap 18 covers an end 73 of the actuator shaft 70.

The switch operator 16 also includes a torsion spring 74 that can be disposed between the actuator shaft 70 and the bushing 24. One end 76 of the torsion spring can be affixed to the cap 18 while the other end 76 can be affixed to the bushing 24. When assembled, the torsion spring 74 may bias the cap 18 away from the bushing 24 to retain the cap 18 in the unactuated position.

The switch operator 16 further includes a detent assembly 82 that can be employed to retain the switch operator 16 in the unactuated position and in the actuated position. The detent assembly 82 can be disposed in diametrically opposed apertures, such as slots 80 of the actuator shaft 70. The detent assembly 82 includes a pair of detents 84 that are biased from one another by one or more springs 86. The detents 84 can each be disposed in one of the slots 80 with the springs 86 extending through the interior of the actuator shaft to separate the detents 84 from one another. When assembled in the actuator shaft 70, the detents 84 extend generally beyond the diameter of the actuator shaft 70. In the illustrated embodiment, the detent assembly 82 includes a pair of diametrically opposed detents 84. However, in other embodiments, the detent assembly 82 may include any number of detents 84 disposed in various positions with respect to one another.

Figure 4:
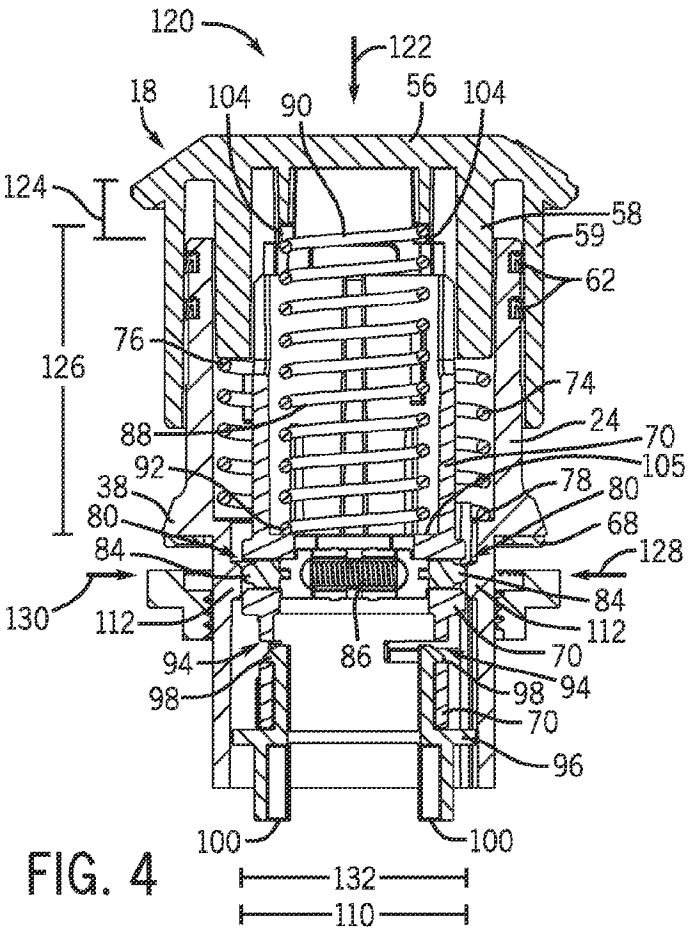
FIG. 4 is a sectional view of the switch operator of FIG. 1 in the triggered position.
Figure 3:
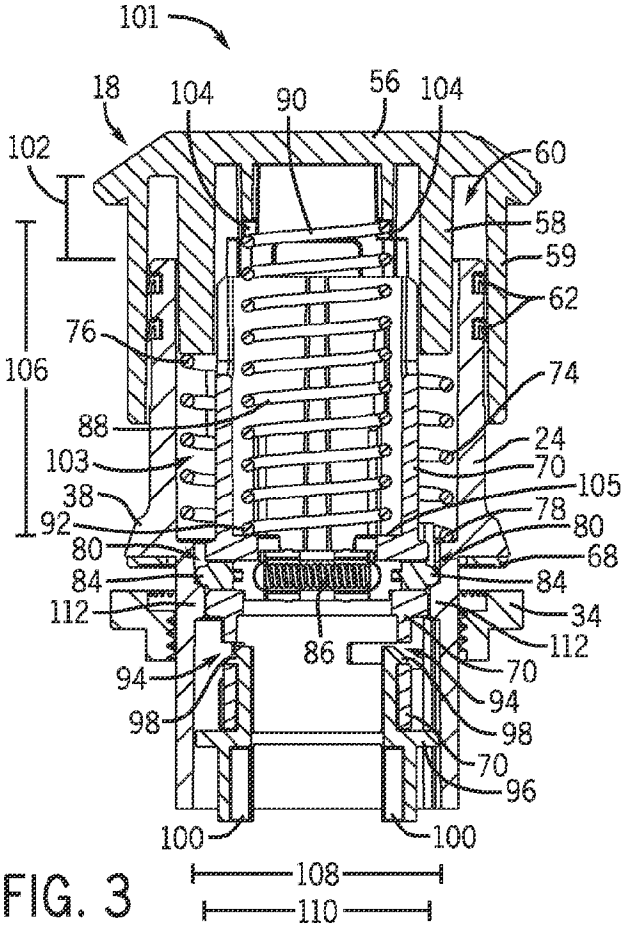
FIG. 3 is a sectional view of the switch operator of FIG. 1 in the unactuated position.
Figure 5:
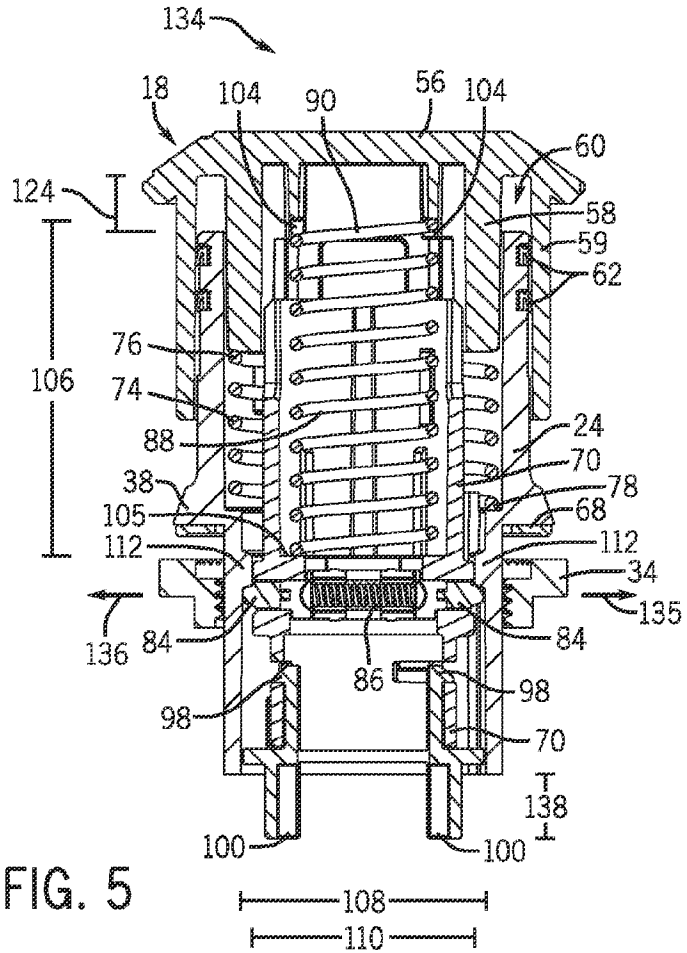
FIG. 5 is a sectional view of the switch operator of FIG. 1 in the actuated position.

As discussed further with respect to FIGS. 3 to 5, the detents 84 can interface with projections or cam surfaces 112 (FIG. 3) on the interior of the bushing 24 to inhibit movement of the actuator shaft 70 with respect to the cap 18. When the switch operator 16 is in the unactuated position, the detent springs 86 bias the detents 84 outwardly from one another beyond the diameter of the actuator shaft 70. Accordingly, in the unactuated position, the detents 84 are retained between the cam surfaces of the bushing 24 and the cap 18, thereby inhibiting movement of the actuator shaft 70 away from the cap 18. However, upon actuation of the cap 18, a drive spring 88, which is inserted inside the actuator shaft 70, compresses and exerts force on the actuator shaft 70, which transfers the force to the detent springs 86 of the detent assembly 82. In particular, one end 90 of the drive spring 88 is disposed in and/or coupled to the cap 56, while the other end 92 seats on a shoulder of the actuator shaft 70.

Upon actuation of the cap 18, the drive spring 88 is compressed to apply force to the actuator shaft 70, which transfers the force to the detent springs 86. The force from the drive spring may overcome the force exerted on the detents 84 by the detent springs 86, causing the detents 84 to move together as the detent springs 86 compress. As the detents 84 move towards one another in the slots 80, the detents may no longer extend past the diameter of the actuator shaft 70, thereby allowing the actuator shaft 70 to move with respect to the bushing 24 and with respect to the cap 18. In particular, the detents 84 can move past the cam surfaces in the bushing 24 allowing the actuator shaft 70 to move inside the bushing 24 away from the cap 18. Once the detents 84 have passed the cam surfaces, the detents 84 can again be biased away from one another by the detent springs 86 to extend beyond the diameter of the actuator shaft 70. Once the detents 84 have re-expanded past the diameter of the actuator, the detents are retained on the opposite side of the cam surfaces from the cap 18 to secure or latch the switch operator 16 in the actuated position.

The movement of the actuator shaft 70 away from the cap 18 in the bushing 24 may cause a portion of the switch operator 16 to extend beyond the bushing 24 to engage electrical contact pairs within a connected contact block 12 (FIG. 1), thereby triggering the switch operator 16. According to certain embodiments, the movement of the detents 84 past the cam surfaces prior to triggering the switch operator 16 may provide the self-latching or anti-tease feature of the switch operator 16.

The actuator shaft 70 includes slots 94 designed to receive an end cap 96 that can be extended past the bushing 24. In particular, tabs 98 of the end cap 96 can be inserted through the slots 94, which allow the end cap 96 to rotate within the actuator shaft 70. The end cap 96 also includes prongs 100 designed to extend through the latch assembly 30 to engage the contact block 12, as shown in FIG. 1. In particular, upon actuation of the cap 18, the drive spring 88 can apply force to overcome the detent springs 86, thereby moving the actuator shaft 70 past the cam surfaces 112 (FIG. 3) and into the triggered position. As the actuator shaft 70 moves away from the cap 18, the end cap 96, which is coupled to the actuator shaft 70, also moves away from the cap 18, causing the prongs 100 of the end cap 96 to extend from the bushing 24 and into the latch assembly 32 (FIG. 1). Within the latch assembly 32, the prongs 100 may contact features of the latch assembly to engage the pairs of electrical contacts within the contact block 12. For example, in embodiments where the switch assembly 10 is an E-Stop, the prongs 100 may engage the contact block 12 to open a normally closed circuit thereby terminating an ongoing function.

FIG. 3 is a sectional view of the switch operator 16 in the unactuated position 101. In the unactuated position 101, the end cap 56 is separated from the bushing 24 by a distance 102, and the torsion spring 74 is relatively uncompressed. As described above with respect to FIG. 2, the bushing 24 extends into the cap 18 between the skirt 59 and the sleeve 58 and may be retained by seals 62, which may allow the cap 56 to rotate with respect to the bushing 24. The sleeve 58 of the cap 18 extends into the annular space 103 between the bushing 24 and the actuator shaft 70. The actuator shaft 70 is coupled to the sleeve 58, and the drive spring 88 is disposed within the actuator shaft 70. One end 90 of the drive spring 88 is fitted within recesses 104 in the end cap 56. The other end 92 of the drive spring 88 seats on a shoulder 105 of the actuator shaft 70.

In the unactuated position 101, the drive spring 88 extends between the recesses 104 and the shoulder 105 at a distance 106 that allows the drive spring 88 to be relatively uncompressed. Accordingly, the drive spring 88 exerts little or no force on the actuator shaft 70. Consequently, the actuator shaft 70 exerts little or no force on the detent springs 86, thereby allowing the detent springs 86 to bias the detents 84 away from one another at a distance 108 that is larger then the diameter 110 of the actuator shaft 70. In the biased position, the detents 84 contact the interior of the bushing 24 and the cam surfaces 112. The contact between the detents 84 and the cam surfaces 112 inhibits movement of the actuator shaft 70 within the bushing 24 away from the cap 56. Accordingly, the actuator shaft 70 and the end cap 96 are retained within the bushing 12. In particular, the prongs 100 of the end cap 96 are contained generally within the bushing 24 to impede contact with the contact block 12 (FIG. 1).

FIG. 4 depicts the switch operator 16 in the actuated position 120 prior to triggering of the actuator shaft 70, which is shown in FIG. 5. As shown in FIG. 4, to actuate the switch operator 16, a user may press the end 56 of the cap 18 towards the bushing 24, as generally shown by an arrow 122. The movement of the cap 18 decreases the distance between the bushing 24 and the end 56 of the cap 18. In particular, the distance between the bushing 24 and the end 56 of the cap 18 may be decreased to a distance 124 that is much smaller than the distance 102 shown in FIG. 3, where the switch operator 116 is in the unactuated position 101.

The movement of the cap 18 also has compressed the torsion spring 74 and the drive spring 88. In particular, the drive spring 88 is compressed and extends for a distance 126 that is smaller than the uncompressed distance 106, shown in FIG. 3. The compression of the drive spring 88 exerts force on the actuator shaft 70, which consequently exerts force on the detents 84. When the force exerted by the drive spring 88 is great enough to overcome the detent springs 86, the detents 84 move inwards towards one another, as generally indicated by the arrows 128 and 130. The inward movement of the detents 84 decreases the distance between the detents 84 to a distance 132 that is generally equal to, or slightly less than, the diameter 110 of the actuator shaft 70. Accordingly, the actuator shaft 70 can now slide past the cam surfaces 112 away from the cap 56 to trigger the switch operator 16.

FIG. 5 depicts the switch operator 16 in the triggered position 134. Upon triggering, the actuator shaft 70 moves past the cam surfaces 112 and the detents 84 expand outwardly from one another, as generally shown by the arrows 135 and 136. In particular, the detents 84 are biased outward by the detent springs 86 to contact the opposite side of the cam surfaces 112 to secure the switch operator 16 in the triggered position 134. In the biased position, the detents 84 are again separated by one another by the distance 108 that is larger than the diameter 110 of the actuator shaft 70.

As can be seen by comparing the actuated position 120 of FIG. 4 to the triggered position 134 of FIG. 5, upon triggering, the actuator shaft 70 moves away from the cap 56, while the cap 56 and the bushing 24 remain stationary with respect to one another. Accordingly, the distance 124 between the end 56 of the cap 18 and the bushing 24 has remained unchanged between the actuated position 120 shown in FIG. 4 and the triggered position 136 shown in FIG. 5. The movement of the shaft 70 with respect to the bushing 24 also has moved the end cap 70 with respect to the bushing 24, causing the prongs 100 to extend beyond the bushing 24 by a distance 138. According to certain embodiments, the prongs 100 may extend through the latch assembly 32 (FIG. 1) to engage the contact block 12 mounted to the latch assembly 32, as shown in FIG. 1.

The switch operator 16 may remain in the triggered position 134 until physical actuation of the switch operator 16 to the unactuated position 101, shown in FIG. 3. In particular, a user may pull the end 56 of the cap 18 away from the bushing 24 to return the switch operator 18 to the unactuated position 101. Further, in certain embodiments, instead of, or in addition to, pulling the end 56, a user may twist the end 56 to return the switch operator 18 to the unactuated position 101. For example, in certain embodiments, the cam surfaces 112 may extend only partially around the inner circumference of the bushing 24. In these embodiments, twisting of the end cap 56 also may twist the actuator shaft 70 with respect to the bushing 24, causing the detents 84 to disengage from the cam surfaces 112. During twisting, the slots 94 in the actuator shaft 70 may allow the actuator shaft 70 to rotate while the end cap 96 remains stationary. In particular, the slots 94 may slide along the tabs 98 of the end cap 96 when the actuator shaft 70 is twisted.

Figure 6:
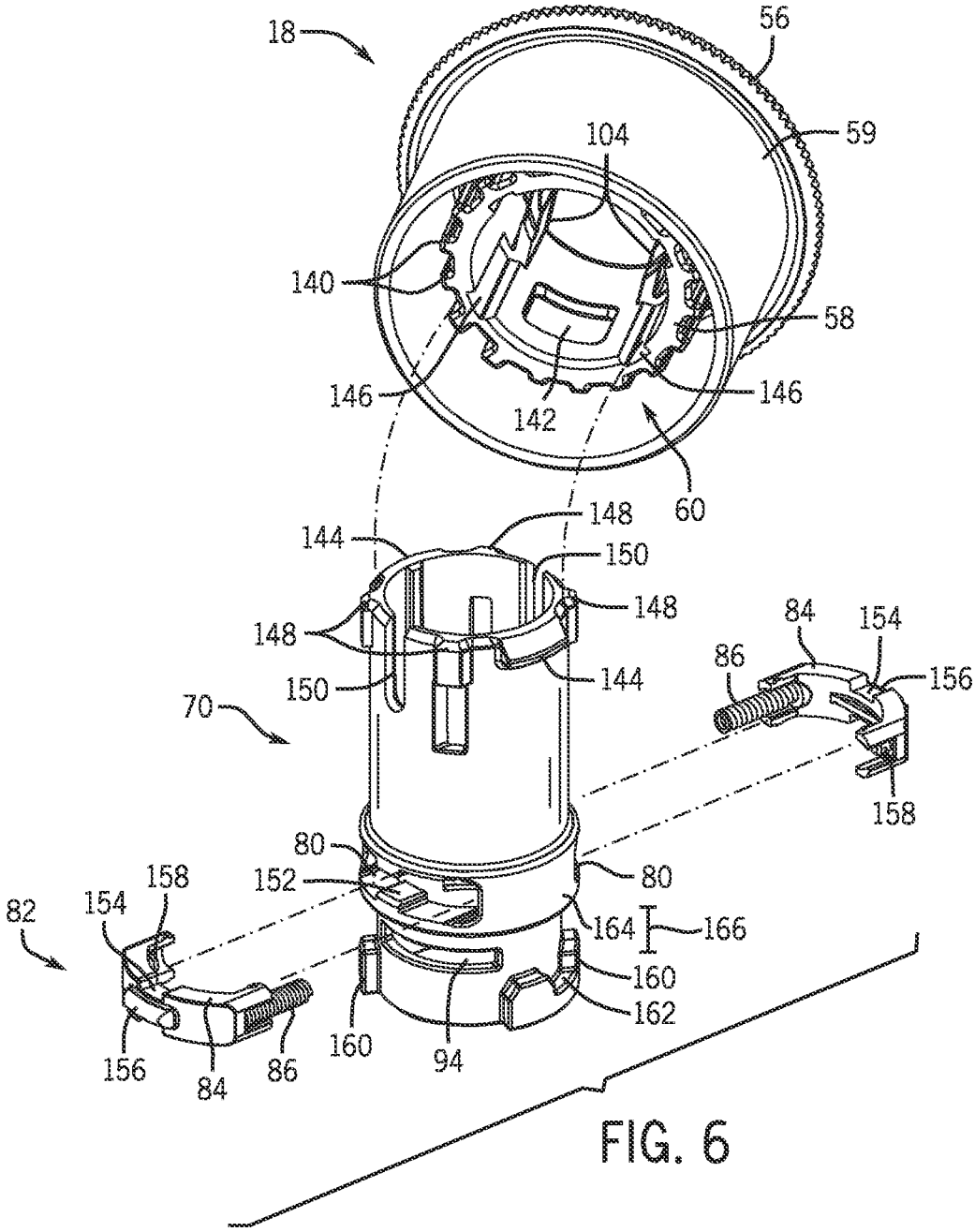
FIG. 6 is an exploded view of certain components of the switch operator of FIG. 1.

FIG. 6 is an exploded view of a portion of the switch operator 16 that includes the cap 18, the actuator shaft 70, and the detent assembly 82. The cap 18 includes the skirt 59 and the sleeve 58, both of which extend generally orthogonal to the end 56 of the cap 18. As noted above, according to certain embodiments, the cap 18 may be molded as a single piece. As described above with respect to FIG. 3, the bushing 24 is disposed within the annular space 60 between the skirt 59 and the sleeve 58. The sleeve 58 includes a series of teeth 140 designed to retain the bushing 24 within the annular space 60. The sleeve 58 also includes one or more recesses 142 designed to mate with complementary tabs 144 on the actuator shaft 70. The tabs 144 and the recesses 142 may be employed to secure the actuator shaft 70 to the cap 56. In particular, the tabs 144 may be snapped into the recesses 142 to attach the actuator shaft 70 to the cap 56. The sleeve 58 further includes a series of grooves 146 designed to mate with tabs 148 on the actuator shaft 70. The grooves 146 may facilitate alignment of the actuator shaft 70 within the cap 56 and/or may retain the tabs 144 to further secure the actuator shaft 70 to the cap 56.

According to certain embodiments, the actuator shaft 70 may be snapped by hand into the cap 86 to secure the tabs 144 within the recesses 142 and to secure the tabs 148 within the grooves 146. The actuator shaft 70 also includes one or more grooves 150 that extend longitudinally along the actuator shaft 70 to permit flexing of the actuator shaft 70 during connection and/or disconnection of the actuator shaft 70 to the cap 18.

As discussed above with respect to FIG. 2, the actuator shaft 70 includes the slots 80 for receiving the detents 84. As shown in FIG. 6, the slots 80 are located on opposite sides of the actuator shafts to diametrically oppose the detents 84 from one another. The slots 80 include alignment features 152 designed to mate with complementary alignment features 154 on the detents 84 to align the detents 84 within the slots 80. The alignment features 152 also allow the detents 84 to slide towards one another and away from one another within the slots 80.

Upon insertion into the slots 80, the detents 84 may be biased away from one another by the springs 86 so that projections 156 on the detents 84 extend outside of the actuator shaft 70. The springs 86 can be coupled to knobs 158 on the detents 84. Upon actuation of the cap 56, the detent springs 86 may be overcome by the force from the drive spring 88 (FIG. 4), and the detent springs 86 may compress while the detents 84 move towards one another so that the projections 156 do not extend beyond the actuator shaft 70. The actuator shaft 70 may then move past the cam surfaces 112 within the bushing, as shown in FIGS. 4 and 5.

The actuator shaft 70 also includes retention features 160 for securing the actuator shaft 70 to the bushing 24. According to certain embodiments, the retention features 160 may be designed to mate with corresponding retention features disposed on the inner walls of the bushing 24. Further, in certain embodiments, the bushing 24 may include multiple retention features designed to alternately engage the retention features 160 on the actuator shaft as the actuator shaft 70 is rotated within the bushing 24. For example, in certain embodiments, four tabs may extend towards the interior of the bushing 24 to mate with the retention features 160. The retention features 160 may couple to the corresponding retention features of the bushing 24 to impede removal of the actuator shaft 70 from the bushing 24. The retention features 160 also may include a recess 162 that is separated from a collar 164 of the actuator shaft 70 by a distance 166. According to certain embodiments, the distance 166 may determine the distance that the actuator shaft 70 travels within the bushing 24 in response to actuation of the switch operator 16.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A switch operator, comprising:

a single piece actuator shaft;

a bushing annularly disposed around the single piece actuator shaft to form a first annular space therebetween;

a cap coupled to the single piece actuator shaft to cover an end thereof and having an annular sleeve disposed in the first annular space; and wherein the cap comprises an annular skirt disposed around the annular sleeve to form a second annular space therebetween, and wherein the bushing is disposed in the second annular space.

2. The switch operator of claim 1, wherein the cap is snapped onto the single piece actuator shaft, and wherein the bushing is coupled to the single piece actuator shaft.

3. The switch operator of claim 1, wherein the annular sleeve comprises at least one recess, and wherein the single piece actuator shaft comprises at least one tab configured to snap into the recess to couple the cap to the single piece actuator shaft.

4. The switch operator of claim 1, wherein the single piece actuator shaft comprises one or more slots extending longitudinally along the shaft to allow the single piece actuator shaft to flex during coupling of the single piece actuator shaft to the cap.

5. The switch operator of claim 1, wherein the bushing is slidably disposed in the second annular space.

6. The switch operator of claim 1, wherein the sleeve comprises teeth annularly spaced around the sleeve and extending into the second annular space to contact the bushing.

7. The switch operator of claim 1, wherein the cap comprises an end piece disposed over the end of the single piece actuator shaft, and wherein the sleeve and the skirt extend orthogonally from the end piece.

8. The switch operator of claim 7, wherein the cap comprises a unitary molded component.

9. A switch operator, comprising:

a single piece actuator shaft having diametrically opposed slots;

a bushing annularly disposed around the single piece actuator shaft to form a first annular space therebetween;

a cap coupled to the single piece actuator shaft to cover an end thereof and having an annular sleeve disposed in the first annular space;

a drive spring disposed longitudinally within the single piece actuator shaft and configured to interface with the cap;

a detent assembly disposed in the diametrically opposed slots and configured to be overpowered by the drive spring in response to actuation of the cap; and wherein the detent assembly comprises a pair of detents, each disposed in one of the diametrically opposed slots, and comprises a pair of detent springs configured to bias the detents away from one another.

10. The switch operator of claim 9, wherein the annular sleeve comprises a pair of recesses, and wherein the single piece actuator shaft comprises a pair of tabs each snap fit, respectively, in the pair of recesses.

11. The switch operator of claim 9, wherein the bushing comprises one or more cam surfaces configured to interface with the detent assembly.

12. The switch operator of claim 9, wherein the single piece actuator shaft comprises a retention feature coupled to the bushing, and wherein the retention feature comprises a recess spaced from a collar of the single piece actuator shaft at a distance determinative of actuation travel of the single piece actuator shaft within the bushing.

13. The switch operator of claim 9, wherein the single piece actuator shaft is moveable in the bushing between an actuated position and an unactuated position.

14. The switch operator of claim 9, wherein the single piece actuator shaft is coupled to an end cap having prongs configured to extend beyond the bushing in response to actuation of the cap.

15. A switch operator, comprising:

a single piece actuator shaft having diametrically opposed slots;

a bushing annularly disposed around the single piece actuator shaft to form a first annular space therebetween;

a cap coupled to the single piece actuator shaft to cover an end thereof and having an annular sleeve disposed in the first annular space;

a drive spring disposed longitudinally within the single piece actuator shaft and configured to interface with the cap;

a detent assembly disposed in the diametrically opposed slots and configured to be overpowered by the drive spring in response to actuation of the cap; and wherein the retention feature comprises a recess spaced from a collar of the single piece actuator shaft at a distance determinative of actuation travel of the single piece actuator shaft within the bushing.

16. The switch operator of claim 15, wherein the cap is snapped onto the single piece actuator shaft, and wherein the bushing is coupled to the single piece actuator shaft.

17. The switch operator of claim 15, wherein the annular sleeve comprises at least one recess, and wherein the single piece actuator shaft comprises at least one tab configured to snap into the recess to couple the cap to the single piece actuator shaft.

18. The switch operator of claim 15, wherein the single piece actuator shaft comprises one or more slots extending longitudinally along the shaft to allow the single piece actuator shaft to flex during coupling of the single piece actuator shaft to the cap.

19. The switch operator of claim 15, wherein the cap comprises an annular skirt disposed around the annular sleeve to form a second annular space therebetween, and wherein the bushing is disposed in the second annular space.

20. The switch operator of claim 15, wherein the detent assembly comprises a pair of detents, each disposed in one of the diametrically opposed slots, and comprises a pair of detent springs configured to bias the detents away from one another.

* * * * *